US011913641B1

(12) United States Patent
Stone

(10) Patent No.: US 11,913,641 B1
(45) Date of Patent: Feb. 27, 2024

(54) BRASS BURNER SYSTEM AND METHOD

(71) Applicant: Ray R. Stone, Denver, CO (US)

(72) Inventor: Ray R. Stone, Denver, CO (US)

(73) Assignee: BSG Holdings, LLC, Denver, CO (US)

( * ) Notice: Subject to any disclaimer, the term of this patent is extended or adjusted under 35 U.S.C. 154(b) by 93 days.

(21) Appl. No.: 16/445,968

(22) Filed: Jun. 19, 2019

(51) Int. Cl.

| | |
|---|---|
| ***F24C 15/06*** | (2006.01) |
| ***F23C 3/00*** | (2006.01) |
| ***F23D 14/28*** | (2006.01) |
| ***F23D 14/48*** | (2006.01) |
| ***F23D 14/58*** | (2006.01) |

(Continued)

(52) U.S. Cl.
CPC ..... *F23C 3/002* (2013.01); *F23D 14/28* (2013.01); *F23D 14/48* (2013.01); *F23D 14/58* (2013.01); *F24C 15/06* (2013.01); *F23D 11/44* (2013.01); *F23D 2206/0094* (2013.01);

(Continued)

(58) Field of Classification Search
CPC . F23D 11/44; F23D 3/00; F23D 14/06; F23D 14/64; F23D 11/10; F23D 91/02; F23D 14/583; F23D 14/72; F23D 14/465; F23D 2203/1017; F23D 2209/10; F23D 5/00; F23D 1/00; F23D 14/16; F23D 14/38; F23D 2203/10; F23D 11/001; F23D 14/28; F23D 14/54; F23D 14/725; F23D 14/82; F23D 2203/1012; F23D 11/30; F23D 11/46; F23D 14/12; F23D 14/22; F23D 11/12; F23D 11/24; F23D 11/40; F23D 11/441; F23D 11/443; F23D 14/02; F23D 14/48; F23D 14/70; F23D 17/00; F23D 17/002; F23D 2207/00; F23D 2700/005; F23D 2700/021; F23D 2700/023; F23D 3/02; F23D 5/126; F23D 11/108; F23D 11/386; F23D 14/00; F23D 14/04; F23D 14/20; F23D 14/30; F23D 14/32; F23D 14/42; F23D 14/50; F23D 14/58; F23D 14/76; F23D 14/825; F23D 2203/102; F23D 2206/0063; F23D 2206/0094; F23D 2700/019; F23D 2700/025; F23D 2700/032; F23D 2900/03081; F23D 2900/14001; F23D 2900/14481; F23D 3/08; F23D 3/10; F23D 3/16; F23D 3/18; F23D 3/22; F23D 3/24; F23D 3/40; F23D 5/14; F23D 11/008; F23D 11/08; F23D 11/105; F23D 11/345;

(Continued)

(56) References Cited

U.S. PATENT DOCUMENTS 666,193 A * 1/1901 Harvey ..... F23D 11/44 431/247
668,548 A * 2/1901 Vogel ..... F23D 11/44 431/229

(Continued)

*Primary Examiner* — Alfred Basichas
(74) *Attorney, Agent, or Firm* — Richard Eldredge; Leavitt and Eldredge Law Firm

(57) ABSTRACT

A brass burner system includes a channel system having a central connection with a first extended element, a second extended element, a third extended element, and a fourth extended element; gas jets engaged with the channel system via a connections, each jet having a top jet portion with an opening; a body portion with a channel connecting to the opening; and a tapered end to engage with one of the connections; the tapered end is to seal within the connection; the brass burner is to produce a decorative flame via the gas jets; and the channel system is to allow gas flow to the gas jets.

3 Claims, 7 Drawing Sheets

(51) Int. Cl.
*F23D 11/44* (2006.01)
*F24C 3/08* (2006.01)

(52) U.S. Cl.
CPC ..... *F23D 2900/14003* (2013.01); *F23D 2900/14641* (2013.01); *F24C 3/08* (2013.01)

(58) Field of Classification Search
CPC . F23D 2900/14641; F23D 2900/14003; F24C 3/08; F24C 15/06; F23C 3/002
USPC ..... 285/120
See application file for complete search history.

(56) References Cited

U.S. PATENT DOCUMENTS 967,315 A * 8/1910 Blount ..... F23D 11/44 431/248
1,539,420 A * 5/1925 Kerr ..... F23D 14/04 431/286
1,680,638 A * 8/1928 Rowan ..... F23D 91/02 374/10
1,790,970 A * 2/1931 Braybrooks ..... F23D 11/38 239/495
2,104,177 A * 1/1938 Yancey ..... F16L 41/021 29/213.1
2,349,323 A * 5/1944 Whittington ..... F23D 14/22 431/355
2,799,330 A * 7/1957 Donges ..... F23D 14/48 431/329
3,365,166 A * 1/1968 Smith ..... G05D 7/0146 251/121
D240,131 S * 6/1976 Dwyer ..... D23/263
4,105,394 A * 8/1978 Reed ..... F23G 7/085 431/5
4,188,183 A * 2/1980 Zink ..... F23G 7/08 431/5
5,282,458 A * 2/1994 Trimble ..... F24C 3/14 126/373.1
5,445,516 A * 8/1995 Stouffer ..... F23D 14/28 D23/207
D375,540 S * 11/1996 McDonald ..... D23/207
2015/0275333 A1 * 10/2015 Tameda ..... C22C 9/04 251/368

* cited by examiner

BRASS BURNER SYSTEM AND METHOD

BACKGROUND

1. Field of the Invention

The present invention relates generally to decorative flame systems, and more specifically, to a brass burner system with a plurality of jets that create a tight seal within a connection for an improved aesthetical and functional configuration.

2. Description of Related Art

Decorative flame systems are well known in the art and are effective means to provide an aesthetically pleasing fixture. Decorative flame systems are conventionally used outdoors, such as in combination with landscaping, to provide a flame that is appealing to homeowners, business owners, and the like.

One style of creating a decorative flame, is through the use of a brass burner system, wherein the brass burner has a chamber system to facilitate transfer of gas to one or more jets, wherein the jets emit flames therefrom for decoration.

There is always room for improvement in these systems, and it is accordingly an object of the present invention to provide an improved brass burner system that provides for an improved seal between jets and connection points to a gas chamber, which is more efficient and can aid in creating a more aesthetically appealing flame.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
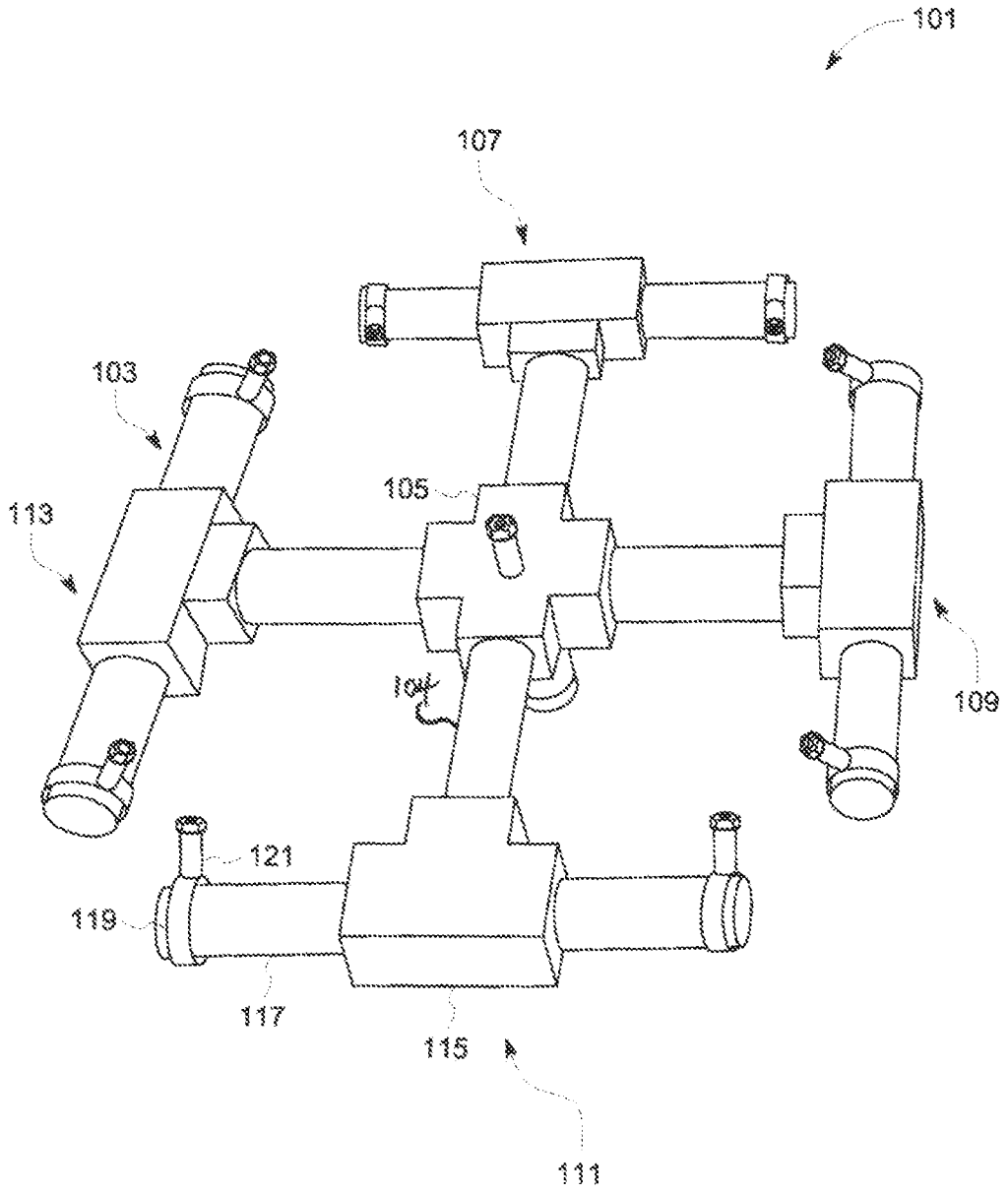
FIG. 1 is an isometric view of a brass burner system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2-7 depict various views of a brass burner system and elements of a brass burner system in accordance with a preferred embodiment of the present application.

Figure 2:
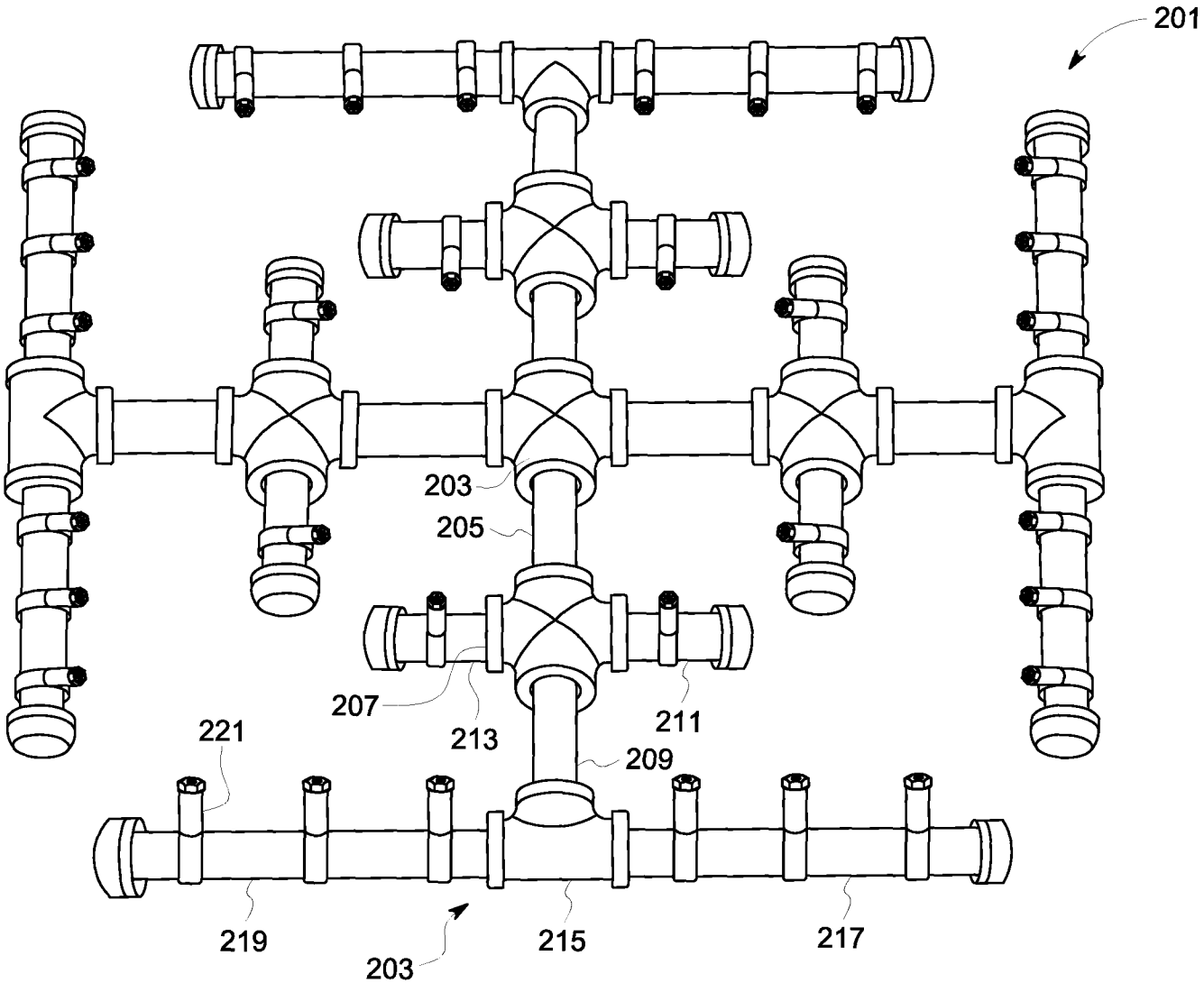
FIG. 2 is a top view of an alternative embodiment of a brass burner system in accordance with the present invention.

In the contemplated embodiment, system 101 includes a channel system 103 having a central connection 105 with a first extended element 107, a second extended element 109, a third extended element 111, and a fourth extended element 113. It should be appreciated that in the preferred embodiment, the central connection 105 is a cross connection, however, it is contemplated that the central connection 105 could vary, such as a T-connection or the like. In the preferred embodiment, the components are composed of brass, however, it is contemplated that alternative materials could be used. It should further be appreciated that the precise configuration of the extended elements can vary based on need and aesthetical considerations. For example, as shown in FIG. 2, the system 201 can be expanded outward to increase the size of the system. It should further be appreciated that the system can be expanded in just one direction, or expanded further, based on user needs.

In system 101, the burner system further includes a first connection 104 extending to a T-connection 115 and having one or more sides connections 117 with one or more jets 121 attached to one or more caps 119 via connections. It should be appreciated that the system can include a plurality of jets, arranged in a variety of configurations, wherein the jets are configured to put out flames via gas channeled through the system. It should be appreciated that the plurality of jets can be attached to caps, rings, or directly to the connections, such that they are in gaseous communication with a gas supply.

As shown in FIG. 2, the system is expandable and can include a configuration wherein the first extended element includes a first connection 205 extending from the central connection 203 to a cross connection 207, the cross connection 207 having a first side connection 213 and a second side connection 211 extending therefrom and including one or more jets. System 201 further includes another connection 209 connected to a T-connection 215. As shown, the T-connection 215 can include a first side connection 219 and second side connection 217 with a plurality of jets 221.

It should be appreciated that one of the unique features believed characteristic of the present application is the configuration of the plurality of jets and the connections to the channel system, wherein gas can travel through the channel system to the plurality of jets. The jets include tapered sides to secure tightly to the connections to prevent and/or reduce gas leakage between the connection point.

Figure 3A:
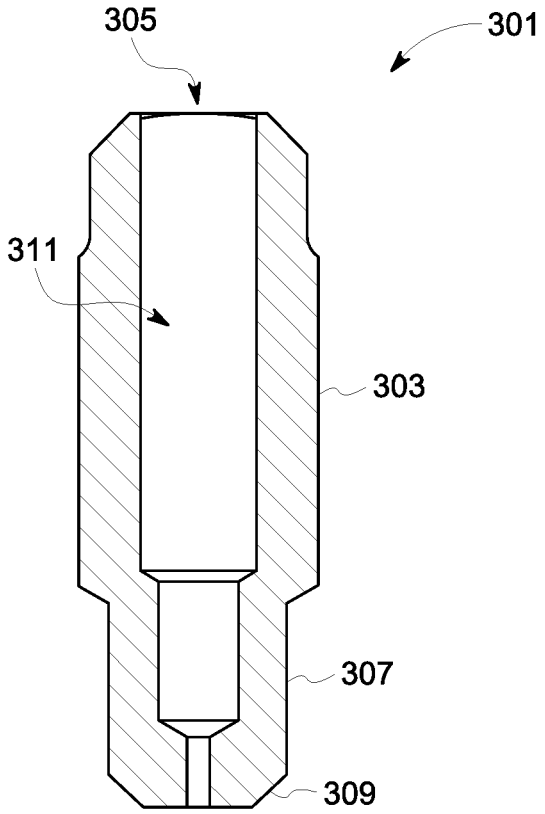
FIG. 3A is a cross sectional view of a jet in accordance with a preferred embodiment of the present application.
Figure 3B:
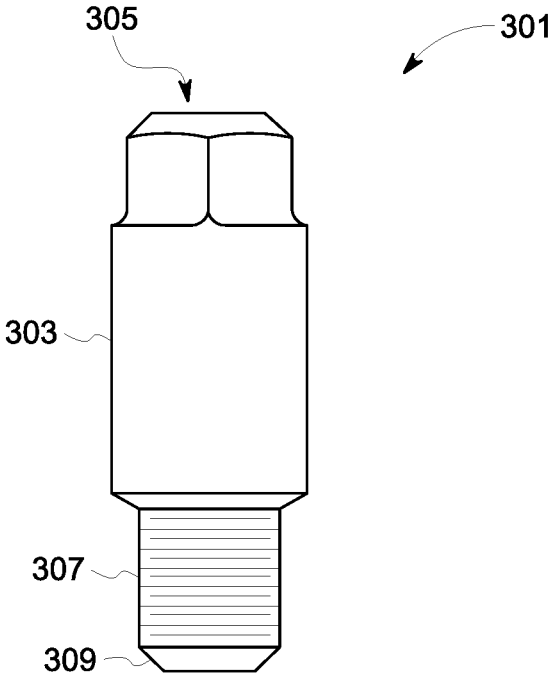
FIG. 3B is a side view of the jet of FIG. 3A.

In FIGS. 3A and 3B, a first configuration of a jet 301 is shown, the jet 301 having a top jet portion 303 with an opening 305; a body portion 307 with a channel 311 connecting to the opening; and a tapered end 309 configured to engage with one of the plurality of connections; wherein the tapered end is configured to seal within the one of the plurality of connections. As shown, the jet 301 can further include threads for creating a tighter seal.

Figure 4A:
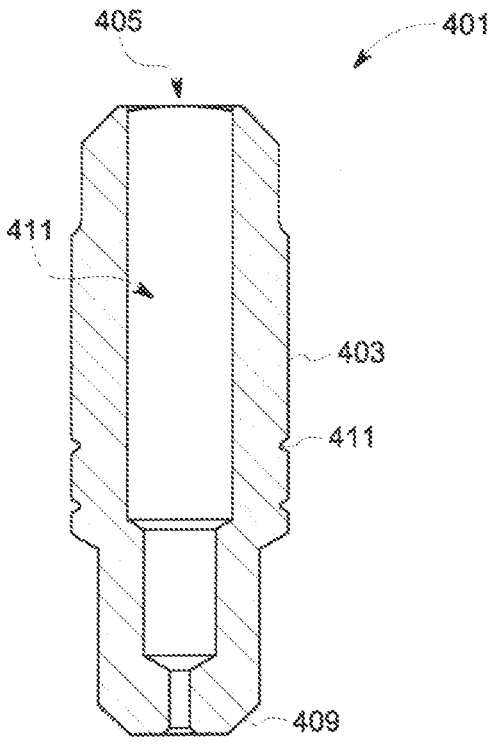
FIG. 4A is a cross sectional view of an alternative embodiment of a jet in accordance with a preferred embodiment of the present application.
Figure 4B:
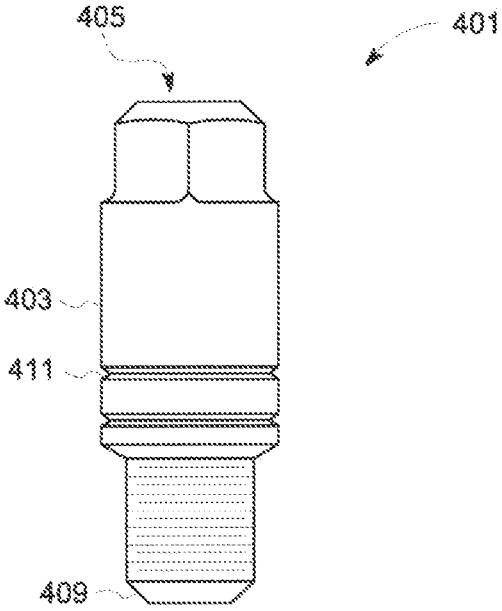
FIG. 4B is a side view of the jet of FIG. 4A.

In FIGS. 4A and 4B, a second configuration of a jet 401 is shown, the jet 401 having a top jet portion 403 with an opening 405; a body portion 401 with a channel 411 connecting to the opening; and a tapered end 409 configured to engage with one of the plurality of connections; wherein the tapered end is configured to seal within one of the plurality of connections. As shown, the jet 401 can also include threads. In this embodiment, the jet further includes one or more grooves 411 for a ring or the like.

Figure 5:
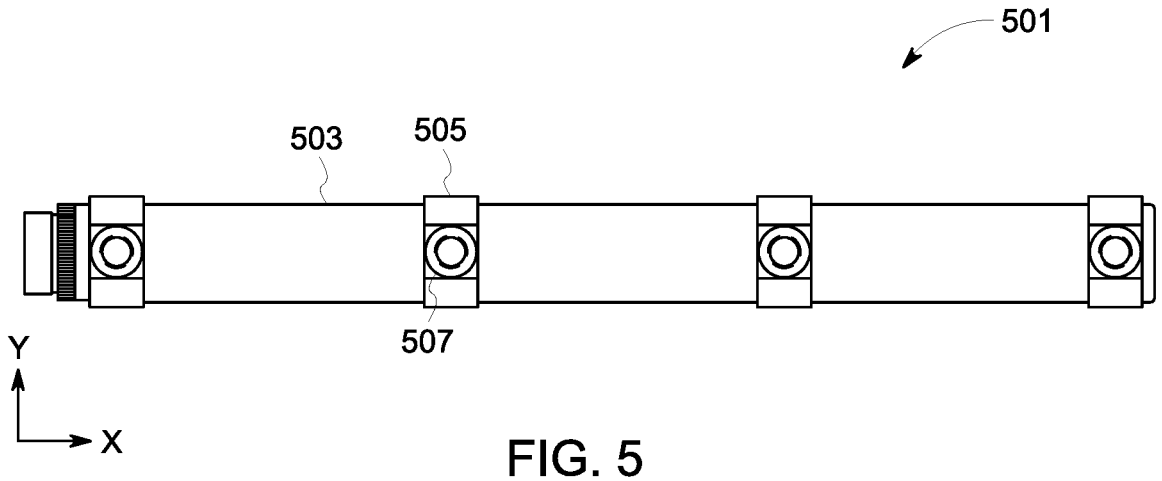
FIG. 5 is a top view of one section for use with the system of FIG. 1.
Figure 6:
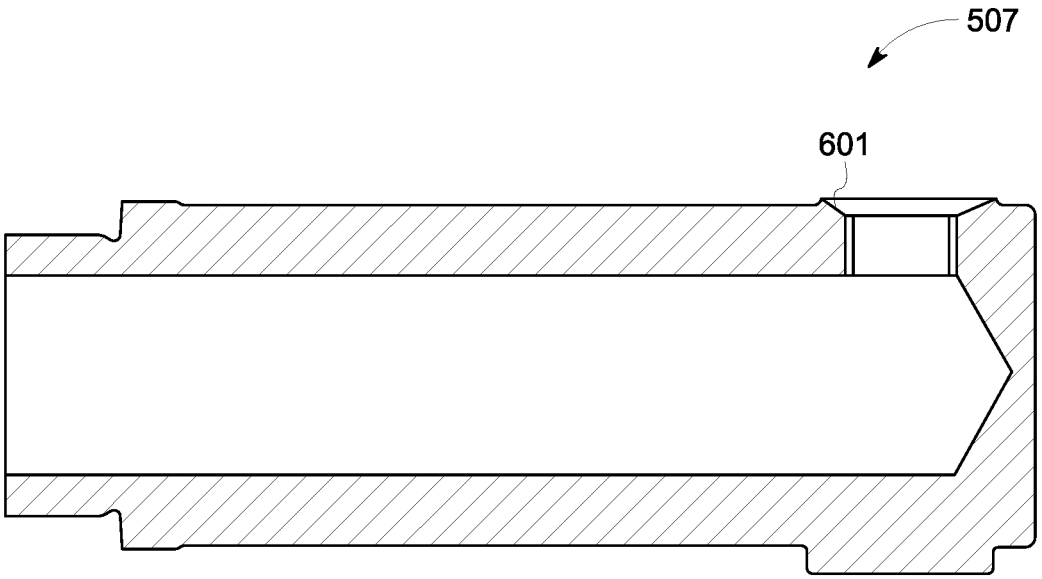
FIG. 6 is a side cross sectional view of a connection in accordance with the system of FIG. 1.

In FIG. 5, an example of an extended element 501 for connection to one of the T-connections or cross connections, is shown, having a channel 503 with one or more connections 507 connected via one or more rings 505. In FIG. 6, an example of a connection 507 is shown, having tapered side walls 601 to sealing with one of the jets.

Figure 7:
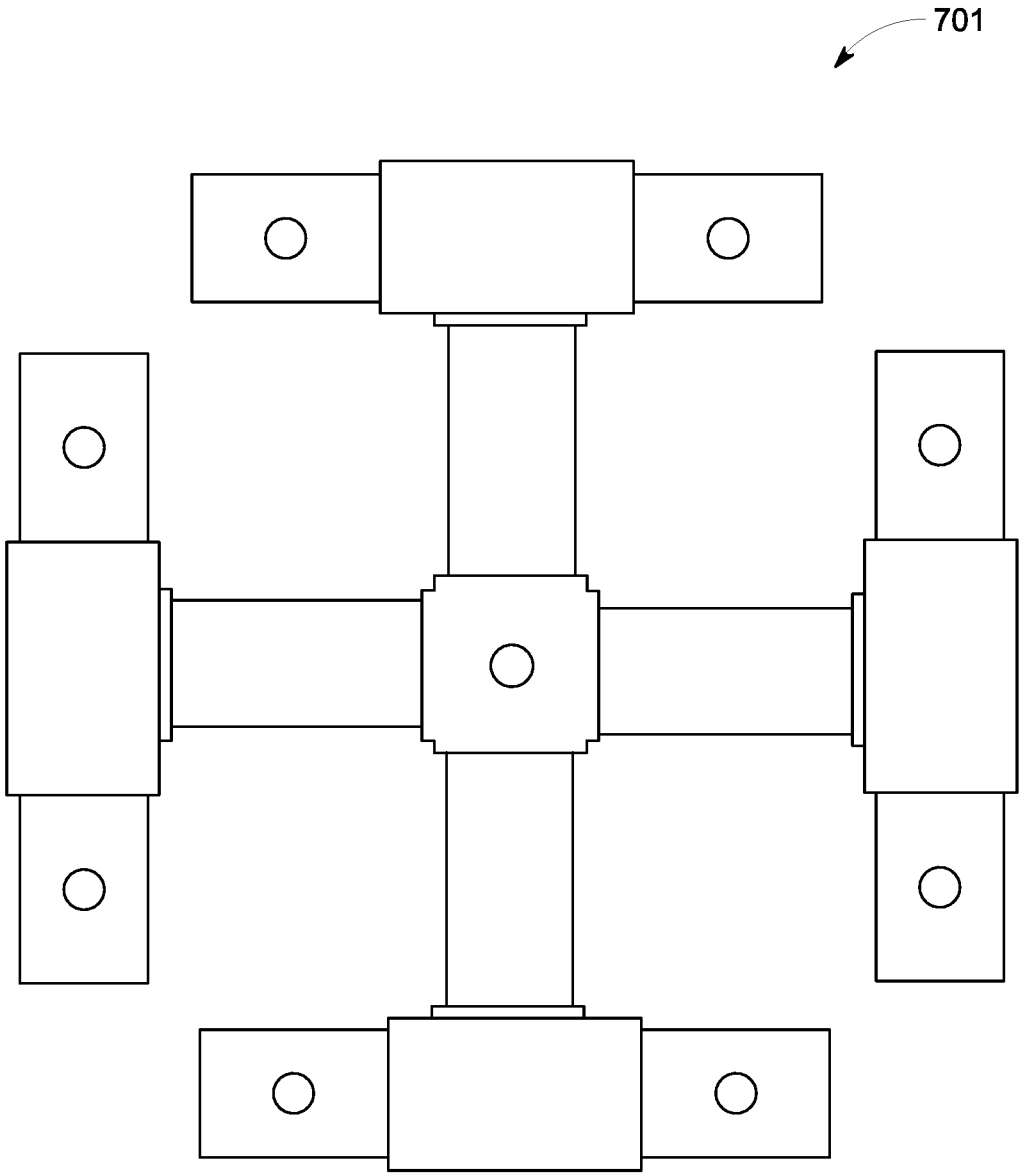
FIG. 7 is a top simplified schematic of a brass burner system in accordance with the present invention.

In FIG. 7, a simplified schematic depicts a brass burner system 701 for clarity, again, it should be appreciated that the system can be expanded and configured as desired for the decorative flame desired.

Figure 8:
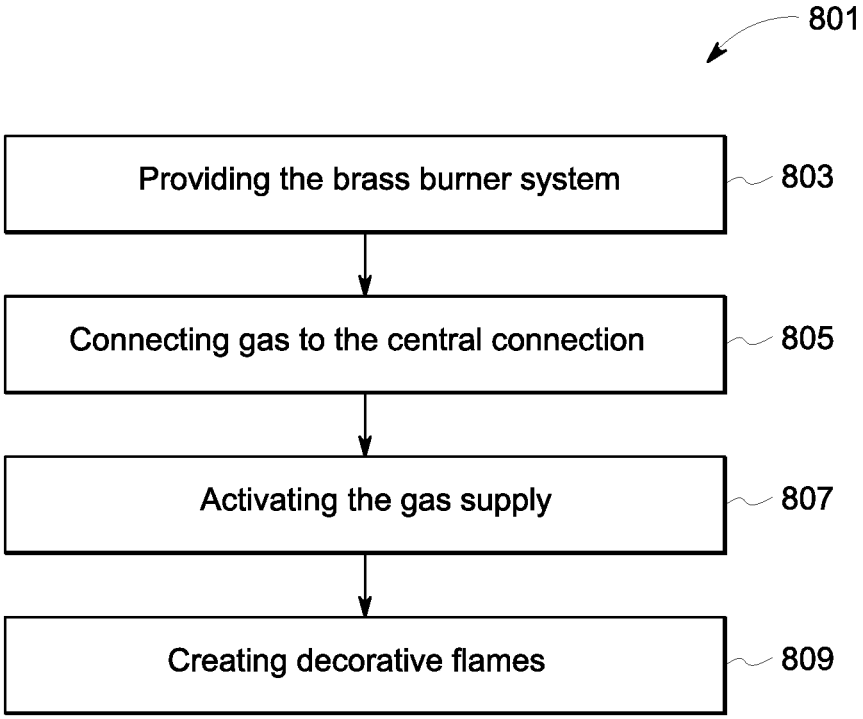
FIG. 8 is a flowchart of a method of use of the system of the present invention.

In FIG. 8, a flowchart 801 depicts the method of use of the system of the present invention. As shown, during use, the brass burner system is provided in a needed configuration, of a needed size, and the like, as shown with box 803. The central connection is connected to a gas supply and the gas supply is activated, as shown with boxes 805, 807. The decorative flame is thereby created as desired by the user, as shown with box 809.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A brass burner system, comprising:

a channel system having a central connection having a central jet; and a plurality of gas jets engaged with the channel system via a plurality of connections, the plurality of gas jets are oriented in a direction towards the central jet, each of the plurality of gas jets having:

a top jet portion with an opening;

a body portion with a channel connecting to the opening; and a tapered end configured to engage with the channel system, the tapered end having a plurality of thread that threadedly engages with the central connection;

wherein a diameter of the channel gradually tapers down from the top jet portion to the tapered end;

wherein the tapered end is configured to seal within the one of the plurality of connections;

wherein the brass burner is configured to produce a flame via the plurality of gas jets; and wherein the channel system is configured to allow gas flow to the plurality of gas jets.

2. The system of claim 1, wherein the one of the plurality of connections further includes tapered side walls to engage with the tapered end of one of the plurality of gas jets.

3. The system of claim 1, wherein the plurality of gas jets are engaged with the channel system via one or more end caps.

* * * * *